United States Patent [19]

Köbler

[11] 4,351,386

[45] Sep. 28, 1982

[54] INTERNALLY COOLED ROLLER BODY CONSTRUCTION

[75] Inventor: Ingo Köbler, Gessertshausen, Fed. Rep. of Germany

[73] Assignee: M.A.N.-Roland Druckmaschinen Aktiengesellschaft, Augsburg, Fed. Rep. of Germany

[21] Appl. No.: 160,231

[22] Filed: Jun. 17, 1980

[30] Foreign Application Priority Data

Jul. 5, 1979 [DE] Fed. Rep. of Germany ..... 2927198

[51] Int. Cl.[3] ..... F28F 5/02

[52] U.S. Cl. ..... 165/89

[58] Field of Search ..... 165/87–90, 165/91, 92; 29/113, 116, 120, 114

[56] References Cited

U.S. PATENT DOCUMENTS

| | | | |
|---|---|---|---|
| 1,453,113 | 4/1923 | Hutchins | 165/89 |
| 1,837,562 | 12/1931 | Mayer | 165/89 |
| 2,015,747 | 10/1935 | Drake | 165/90 |
| 2,783,977 | 3/1957 | Seanor | 165/89 |
| 2,793,006 | 5/1957 | Eaby | 165/89 |

*Primary Examiner*—Samuel Scott
*Assistant Examiner*—Theophil W. Streule, Jr.
*Attorney, Agent, or Firm*—Frishauf, Holtz, Goodman & Woodward

[57] ABSTRACT

To provide for axial guidance of cooling fluid, typically water, through a double-jacketed cooling roller which has an outer jacket (5) rotatably positioned over an inner stationary displacement body (6), in which the inner displacement body is smaller than the inner surface of the outer jacket to define a space (19) for flow of cooling fluid therethrough, the inner surface of the outer rotating jacket (5) is formed with spirally extending surface deformations (16), such as grooves or ridges or ribs or vanes, to transport water being centrifugally pressed against the inner walls of the rotating jacket (5) in axial direction. The axial end of the chamber (19) preferably is formed by an enlarged radially extending chamber (21) in which guide vanes (22) are located to return water flow to a hollow central shaft (9) for removal of cooling fluid axially therethrough. The hollow shaft (9) preferably acts as a central stationary shaft about which the outer jacket (5) rotates, so that rotary seals for water supply and removal can be eliminated.

10 Claims, 2 Drawing Figures

INTERNALLY COOLED ROLLER BODY CONSTRUCTION

Figure 1:
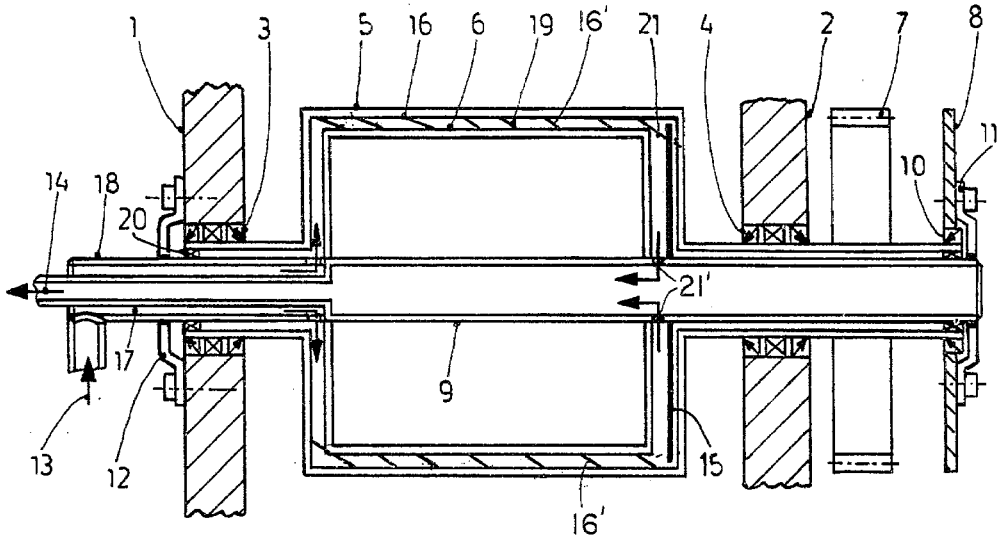

The present invention relates to a roller construction in which the roller can additionally act as a cooling element, so that the surface of the roller can provide a cooling effect on material with which it is in contact, for example web material on which printing is to be, or has been, effected.

BACKGROUND AND PRIOR ART

Various types of cooled rollers are known, and the present invention is particularly directed to a double-walled cooling roller which has a cooling medium applied thereto concentric with the axis of rotation of the roller. German Utility Model No. 72 09 772 describes a double-walled cooling roller with centrally arranged cooling medium circuit connections positioned at one axial end thereof. The space between an inner and an outer jacket of the roller forms a flow chamber. This double-walled cooling roller has a drain connection at one axial end thereof which is adjacent the supply connection thereto.

The cooling medium is pumped in the space between the inner and outer jacket of the roller. This requires comparatively high pumping pressure. The high pumping pressure results, in part, due to the centrifugal force which is applied to the cooling medium upon rotation of the roller which is counter the direction of flow to a central supply or removal duct. The high pressure causes problems in connection with sealing of the cooling fluid. At high rotary speeds, a ring of cooling fluid, typically water, will result which interferes with efficient axial flow of the cooling water, and hence proper flow of the cooling medium throughout the space adjacent the outer jacket of the cooling roller.

It has previously been proposed to provide a separate motor driven fluid distribution drive or pump in flow connection with the cooling fluid in order to improve the flow relationships in the interior of the double-walled cooling roller. Such arrangements cause additional expense and, as has been found, are subject to malfunction.

THE INVENTION

It is an object to provide a heat exchange and specifically a cooling roller of the double-jacketed type which has effective cooling flow therethrough and which does not require either additional pumps or flow-inducing elements or high supply pressures.

Briefly, in accordance with the invention, the inner body defining one wall portion of the chamber through which the cooling fluid flows, is a fixed displacement element, for example a cylindrical body, rigidly secured within a frame. The outer body forms the roller and the inner walls thereof define other side walls of the cooling chamber. The inside of the roller is formed with spirals presenting surface discontinuities, for example in the form of ridges or in the form of depressions, in order to provide for axial transport of cooling fluid supplied to the chamber at an axial end portion for transport towards the other axial end portion. Of course, if the supply is central of the cooling roller, oppositely directed spirals can direct the fluid towards opposite axial ends.

The arrangement has the advantage that sufficient axial speed of the cooling fluid is obtained, so that the cooling fluid will flow in the chamber defined between the central displacement body and the outer roller, thereby insuring effective cooling of the outer roller, without requiring high supply pressures to overcome centrifugal forces acting on the cooling fluid itself.

DRAWINGS

Figure 2:
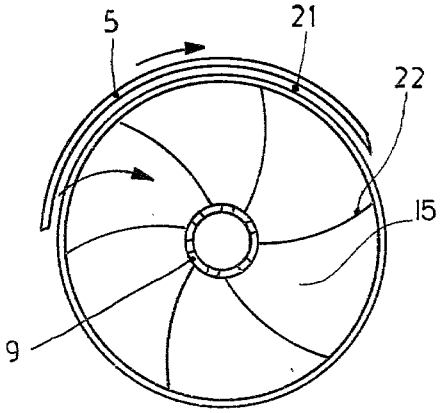

FIG. 1 is a highly schematic longitudinal cross-sectional view through a cooling roller and the bearing therefor, and showing also the cooling fluid connections and ducts; and FIG. 2 is a schematic end view illustrating a quieting or turbulence reducing chamber including guide vanes.

Two support frame members 1, 2 have bearings therein to support the cooling roller which has an outer jacket 5. Bearing 3 is secured in the left side wall 1; bearing 4 is secured in the right side wall 2. The outer jacket 5 of the cooling roller has a fixed cylindrical displacement body 6 positioned therein. The displacement body 6 is secured in a bearing 10 within a right-side holder plate 8 and in a bearing 20 positioned beneath the material defining the outer jacket 5. Thus, the displacement body 6 is fixed and does not rotate. A hollow shaft 9 extends axially within the displacement body 6 and forms a support structure therefor, the hollow shaft 9 being the actual element supported in the bearings 10, 20.

A drive wheel 7, for example a gear, is fixedly secured to the outer jacket 5, positioned between the holder 8 and the side wall 2. The cooling roller is closed off by terminal elements 11, 12, for example in plate-like form, and secured, respectively, to the support plate 8 and the wall 1.

A fluid supply pipe 18 is secured about the hollow shaft 9 at the left side, as illustrated in FIG. 1, positioned concentrically about the shaft 9. The hollow shaft 9, at the left side and in the region of the pipe or tube 19, is made of reduced diameter, so that a supply duct or channel 17 is formed by the space between the pipe 18 and the hollow shaft 9. Fluid supplied at stub 13 to the fixed tube 18 is supplied, as shown by the arrows, through duct 17 to a chamber 19 defined between the outer jacket 5 of the roller and the inner, fixed displacement body 6. The tube 18 is formed with suitable flow communication holes at the side adjacent the space between the outer jacket 5 and the displacement body 6, as seen in FIG. 1, which space extends also in axial direction.

In accordance with a feature of the present invention, the inner wall of the outer jacket 5 is formed with surface deformations 16 extending in spiral direction to move cooling fluid, typically water, in axial direction from the left side to the right side (FIG. 1). The deformations may be in form of grooves worked into the inner surface of the jacket 5, or in the form of projecting ridges or projecting vanes 16'. The radial space between the inner displacement body 6 and the outer jacket 5 of the roller can be made slightly larger than that at the left side, to define a quieting or turbulence-eliminating chamber 21. Water transport from the outside towards the inside, that is, to the shaft, is assisted by guide vanes 22 formed or attached to a stationary plate 15 which is, rigidly secured on the hollow shaft 9 (see FIG. 1). Water which was axially transported by the spiral 16 to the chamber 21 is then taken out through the hollow shaft 9 via suitable openings 21' formed therein communicating with chamber 21, for subsequent removal from an axial drain stub 14.

Rotation of the roller 5 causes water to be sucked into the chamber 19 and against the inner wall of the outer jacket 6 due to centrifugal force. The spiral 16 introduces an axial component to move the water axially from the left side towards the right. The centrifugal force which forces the water outwardly and in contact with the rotating jacket 5 must be counteracted, however, at the right side of the roller to return the water back to the shaft axis. The return flow requires substantial pressure. In order to assist the return flow and eliminate the need for additional removal pressure, the quieting chamber 21 is provided bounded by the stationary, inner surface of plate or disk 15 and body 6, preferably additionally including the guide vanes 22 (see FIG. 2) which guide water flow towards the central shaft 9 and through openings 21 therein for axial removal.

No specific transport pumps or other transport devices are necessary for the cooling fluid—typically water—to transport the cooling fluid axially through the cooling roller, and back from the circumference thereof to the axis. This permits operation of a cooling circuit with low pressure differential. Additionally, and as can be seen, the arrangement does not require any rotary fluid connection, so that wear and tear at a rotary water supply connection can be eliminated; nor is it necessary to provide high-pressure seals in the vicinity of the bearings 10, 20 since water supplied at inlet stubs 13 will be drawn by centrifugal force away from bearing 20, and returned to axial direction by the guide vanes 21 at the right side, thus keeping bearing 10 dry. Elimination of rotating water supply connections is a substantial advantage of the arrangement.

The axial deformations 16, forming an axial transport means to define a transport path for the cooling fluid, can be made, as desired, and the specific shape and arrangement is an engineering matter which can be adapted to particular sizes, cooling requirements, and the cooling media used. Forming the deformations 16 in the form of grooves is a simple machining operation; likewise, providing spiral guide vanes or tracks projecting inwardly from the inner surface of jacket 5 is simple and can be made and applied in any suitable manner.

Various changes and modifications may be made within the scope of the inventive concept.

I claim:

1. Cooling roller comprising:

an outer rotatable cylindrical jacket (5);

a stationary concentrically positioned body (6) located therein and forming a stationary fluid displacement body, said body being of smaller diameter than the diameter of the jacket (5) to define a cooling fluid chamber (19) between the rotatable jacket and the stationary body;

spiral surface deformations (16) formed on the inner surface of the outer jacket (5) facing the cooling fluid chamber to provide an axial cooling fluid transport spiral;

a stationary hollow shaft (9);

means (10, 20) rotatably supporting the outer cylindrical jacket (5) on said stationary hollow shaft;

a supply pipe (18) surrounding the hollow shaft, with clearance, to define a supply duct (17) between the supply pipe and the hollow shaft;

means communicating the supply duct (17) with the chamber (19) at one axial end thereof and for subsequent fluid transport, in axial direction by said transport spiral;

a quieting, or settling chamber (21) located at the other axial end of the cooling fluid chamber (19) to reduce turbulence of fluid received from said cooling chamber;

and means (21') conducting cooling fluid from said quieting or settling chamber to the interior of the hollow shaft (9) for removal therefrom.

2. Roller according to claim 1 including a stationary disk or plate (15) secured to the stationary shaft, located in the quieting or settling chamber and defining a quieting space (21) between the stationary fluid displacement body (6) and a facing surface of the stationary disk.

3. Roller according to claim 2 further including a stationary radially directed guide vane (22) on said stationary disk or plate (15) positioned in said quieting or settling chamber (21) and guiding cooling fluid radially inwardly from said cooling chamber (19) to the interior of the hollow shaft (9).

4. Roller according to claim 1, further including stationary radially directed guide vanes (22) positioned in said quieting or settling chamber (21) and guiding cooling fluid radially inwardly from said cooling chamber (19) to the interior of the hollow shaft (9).

5. Roller according to claim 1, wherein the surface deformations (16) forming the transport spiral comprises spirally extending grooves in the inner wall of the outer jacket (5).

6. Roller according to claim 1, wherein the surface deformations forming said transport spiral comprises inwardly extending projections projecting from the inner walls of the outer jacket (5), spirally, into said cooling chamber (19).

7. Roller according to claim 6, wherein said inwardly extending projections comprise spiral ridges, ribs, or vanes.

8. Roller according to claim 4, wherein the surface deformations (16) forming the transport spiral comprises spirally extending grooves in the inner wall of the outer jacket (5).

9. Roller according to claim 4, wherein the surface deformations forming said transport spiral comprises inwardly extending projections projecting from the inner walls of the outer jacket (5), spirally, into said cooling chamber (19).

10. Roller according to claim 9, wherein said inwardly extending projections comprise spiral ridges, ribs, or vanes.

* * * * *